US011183060B2

(12) United States Patent
Zhou et al.

(10) Patent No.: US 11,183,060 B2
(45) Date of Patent: Nov. 23, 2021

(54) PARKING MANAGEMENT SYSTEM AND PARKING MANAGEMENT METHOD

(71) Applicants: BEIJING BOE DISPLAY TECHNOLOGY CO., LTD., Beijing (CN); BOE Technology Group Co., Ltd., Beijing (CN)

(72) Inventors: Xing Zhou, Beijing (CN); Di Xu, Beijing (CN); Kun Lu, Beijing (CN); Ling Bai, Beijing (CN); Qifei Chen, Beijing (CN); Xiaozhe Zhang, Beijing (CN); Liangliang Ren, Beijing (CN); Dongliang Xu, Beijing (CN)

(73) Assignees: Beijing BOE Display Technology Co, Ltd., Beijing (CN); BOE Technology Group Co, Ltd., Beijing (CN)

( * ) Notice: Subject to any disclaimer, the term of this patent is extended or adjusted under 35 U.S.C. 154(b) by 0 days.

(21) Appl. No.: 17/042,204

(22) PCT Filed: Mar. 6, 2020

(86) PCT No.: PCT/CN2020/078254
§ 371 (c)(1),
(2) Date: Sep. 28, 2020

(87) PCT Pub. No.: WO2020/182081
PCT Pub. Date: Sep. 17, 2020

(65) Prior Publication Data

US 2021/0020046 A1 Jan. 21, 2021

(30) Foreign Application Priority Data

Mar. 14, 2019 (CN) ..... 201910194829.2

(51) Int. Cl.
*G08G 1/14* (2006.01)

(52) U.S. Cl.
CPC ..... *G08G 1/142* (2013.01); *G08G 1/145* (2013.01); *G08G 1/149* (2013.01)

(58) Field of Classification Search
CPC ..... G08G 1/142; G08G 1/145; G08G 1/149
(Continued)

(56) References Cited

U.S. PATENT DOCUMENTS 9,666,075 B2 5/2017 Davies et al.
2016/0379495 A1* 12/2016 Engelen ..... G08G 1/146 340/932.2

(Continued)

FOREIGN PATENT DOCUMENTS

CN 204066415 U * 12/2014
CN 204440662 U 7/2015

(Continued)

OTHER PUBLICATIONS

International Search Report for PCT/CN2020/078254 dated Jun. 12, 2020.

(Continued)

*Primary Examiner* — Kam Wan Ma
(74) *Attorney, Agent, or Firm* — Ling Wu; Stephen Yang; Ling and Yang Intellectual Property

(57) ABSTRACT

A parking management system and a parking management method are disclosed. The parking management system includes a control device and a parking space boundary indicating device. The control device is configured to acquire size information of a vehicle to be parked and information of the vacant area where no vehicle is parked in a parking lot, determine parking area information of the vehicle to be parked according to the size information and the information of the vacant area, and send the parking area information to the parking space boundary indicating device; the parking space boundary indicating device is (Continued)

configured to form parking space boundary lines by shedding light on a parking area according to the parking area information.

15 Claims, 5 Drawing Sheets

(58) Field of Classification Search
USPC ..... 340/932.2
See application file for complete search history.

(56) References Cited

U.S. PATENT DOCUMENTS

| | | | | |
|---|---|---|---|---|
| 2017/0166115 | A1* | 6/2017 | Pal | G08G 1/149 |
| 2017/0200367 | A1* | 7/2017 | Mielenz | G05D 1/0246 |
| 2017/0255881 | A1* | 9/2017 | Ritch | G08G 1/096883 |
| 2018/0211539 | A1* | 7/2018 | Boss | G08G 1/144 |
| 2020/0074859 | A1 | 3/2020 | Eshima | |
| 2020/0209886 | A1* | 7/2020 | Lee | G05D 1/0276 |
| 2021/0020046 | A1 | 1/2021 | Zhou et al. | |

FOREIGN PATENT DOCUMENTS

| | | | |
|---|---|---|---|
| CN | 107437341 | A | 12/2017 |
| CN | 206711408 | U | 12/2017 |
| CN | 207165016 | U | 3/2018 |
| CN | 108492574 | A | 9/2018 |
| CN | 109410591 | A | 3/2019 |
| CN | 109961653 | A | 7/2019 |
| JP | H04371678 | A | 12/1992 |
| KR | 20180059253 | A | 6/2018 |

OTHER PUBLICATIONS

Office Action dated Mar. 23, 2020 for Chinese Patent Application No. 201910194829.2 and English Translation.
Office Action dated Aug. 28, 2020 for Chinese Patent Application No. 201910194829.2 and English Translation.
Office Action dated Jan. 5, 2021 for Chinese Patent Application No. 201910194829.2 and English Translation.

* cited by examiner

PARKING MANAGEMENT SYSTEM AND PARKING MANAGEMENT METHOD

The present application claims the priority to the Chinese Patent Application No. 201910194829.2, filed to CNIPA on Mar. 14, 2019 and entitled "Parking management system and parking management method", the content of which should be regarded as being incorporated into this application by reference.

TECHNICAL FIELD

Embodiments of the present disclosure relate to, but are not limited to, the field of electronic technology, in particular to a parking management system and a parking management method.

BACKGROUND

With the development of society, the quantity of urban vehicles is increasing, and parking problems are becoming more and more serious.

FIG. 1 is a schematic diagram of parking spaces in a parking lot. As shown in FIG. 1, in order to facilitate driving of vehicles, lanes are designed to cross horizontally and vertically. In this design, space utilization rate of the parking lot is low and great waste occurs due to too many lanes.

SUMMARY

The following is a summary of subject matter described in detail herein. This summary is not intended to limit the protection scope of the claims.

On one aspect, the embodiment of the disclosure provides a parking management system, which includes a control device and a parking space boundary indicating device, wherein:

the control device, configured to acquire size information of a vehicle to be parked and information of a vacant area where no vehicle is parked in a parking lot, determine parking area information of the vehicle to be parked according to the size information of the vehicle to be parked and the information of the vacant area, and send the parking area information to the parking space boundary indicating device;

the parking space boundary indicating device, connected with the control device, and configured to form parking space boundary lines by shedding light on the parking area according to the parking area information.

In an exemplary embodiment, the parking management system further includes a vehicle image acquisition device and a parking area image acquisition device, wherein:

the vehicle image acquisition device is configured to acquire a vehicle image of a vehicle to be parked and send the vehicle image to the control device;

the parking area image acquisition device is configured to acquire a parking area image of the parking area in the parking lot, and send the parking area image to the control device;

the control device is connected with the vehicle image acquisition device and parking area image acquisition device; and is configured to acquire the size information of the vehicle to be parked from the vehicle image and acquire the information of the vacant area from the parking area image through image processing, determine the parking area information of the vehicle to be parked according to the size information of the vehicle to be parked and the information of the vacant area, and send the parking area information to the parking space boundary indicating device.

In an exemplary embodiment, the information of the vacant area includes the position and size of the vacant area, and the parking area information includes the position and size of the parking area.

In an exemplary embodiment, the information of the vacant area includes the position and size of the vacant area, and the parking area information includes the instruction information for instructing to shedding light to form parking space boundary lines.

In an exemplary embodiment, the parking space boundary indicating device includes:

a guide rail, disposed above the parking area;

a sliding device, slidably disposed on the guide rail and configured to slide to a parking area under the instruction of the controller;

an illumination assembly, disposed on the sliding device and configured to shed light under the instruction of the controller, to form parking space boundary lines from light in the parking area; and a controller, electrically connected with the control device, the sliding device and the illumination assembly; and configured to receive the parking area information, instruct the sliding device to slide to the parking area according to the parking area information, and instruct the illumination assembly to shed light.

In an exemplary embodiment, an ultrasonic transmitting and receiving device is disposed on the sliding device.

In an exemplary embodiment, the illumination assembly includes:

a light shade, connected with the sliding device;

light source disposed in the light shade; and a light adjustment mechanism, disposed at the light outlet of the light shade, and configured to adjust the shape of the parking space boundary lines formed on the ground by changing the shape of the light outlet.

In an exemplary embodiment, the light adjustment mechanism is configured to adjust the shape of the parking space boundary lines formed on the ground according to the instruction of the controller.

In an exemplary embodiment, the light adjustment mechanism includes a pair of width baffles for adjusting width of the light outlet and a pair of length baffles for adjusting length of the light outlet.

In an exemplary embodiment, the parking space boundary indicating device further includes a detection assembly, which is disposed on the sliding device, and is configured to photograph a vehicle being parked and transmit the photographed image to the controller; the controller is further configured to judge whether the vehicle exceeds the parking space boundary lines according to the image, and send out a warning signal when the vehicle exceeds the parking space boundary lines.

In an exemplary embodiment, the parking space boundary indicating device further includes a detection assembly, which is disposed on the sliding device and is configured to photograph a vehicle being parked and transmit the photographed image to the control device; the control device is further configured to judge whether the vehicle exceeds the parking space boundary line according to the image, and instruct the controller to send out a warning signal when the vehicle exceeds the parking space boundary lines.

In another aspect, an embodiment of the present disclosure further provides a method for parking management, including:

acquiring size information of a vehicle to be parked and information of a vacant area where no vehicle is parked in a parking lot; determining parking area information of the vehicle to be parked according to the size information of the vehicle to be parked and the information of the vacant area; and forming parking space boundary lines in the parking area by shedding light.

In an exemplary embodiment, acquiring size information of a vehicle to be parked and information of a vacant area where no vehicle is parked in a parking lot includes acquiring a vehicle image of a vehicle to be parked and a parking area image of a parking area in the parking lot, respectively; through image processing, acquiring the size information of the vehicle to be parked from the vehicle image, and acquiring the information of the vacant area from the parking area image.

In an exemplary embodiment, determining of parking area information of a vehicle to be parked according to size information of the vehicle to be parked and information of a vacant area comprises: determining a parking area suitable for parking the vehicle according to the size information of the vehicle to be parked, the information of the vacant area and preset parking strategy; the preset parking strategy includes: in a parking area, the vehicle is preferentially parked at the position near an entrance and preferentially parked at the edge position of the vacant area.

In an exemplary embodiment, the information of the vacant area includes the position and size of the vacant area, and the parking area information includes the position and size of the parking area.

In an exemplary embodiment, the information of the vacant area includes the position and size of the vacant area, and the parking area information includes the instruction information for instructing to shed light to form parking space boundary lines.

In an exemplary embodiment, the method further includes: judging whether a vehicle being parked exceeds parking space boundary lines, and sending out a warning signal when the vehicle exceeds the parking space boundary lines.

In an exemplary embodiment, forming the parking space boundary lines by shedding light on a parking area includes receiving parking area information; according to the parking area information, instructing an illumination assembly to slide to the parking area; and instructing the illumination assembly to shed light, and forming the parking space boundary lines from light in the parking area.

In another aspect, an embodiment of the present disclosure also provides a computer-readable storage medium storing executable instructions. When the executable instructions are executed by a processor, the parking management method as described in any one of the above is implemented.

Other features and advantages of the present disclosure will be set forth in the following embodiments of the description, or be learned by implementing the present disclosure. Purposes and advantages of the embodiments of the present disclosure may be achieved and obtained by structures specifically pointed out in the specification, claims and drawings.

Other aspects will become apparent upon reading and understanding the accompanying drawings and the detailed description.

BRIEF DESCRIPTION OF DRAWINGS

Accompanying drawings are used to provide a further understanding of technical solutions of the present disclosure, form a part of the specification, and explain technical solutions of the present disclosure together with the embodiments of the present disclosure, while they do not constitute a limitation on the technical solutions of the present disclosure. Shapes and sizes of the components in the drawings do not reflect real proportions, and the purpose is only for schematically describing contents of the present disclosure.

| Illustration of reference signs | |
|---|---|
| 10 | control device; |
| 12 | vehicle image acquisition device; |
| 13 | parking area image acquisition device; |
| 20 | parking space boundary indicating device; |
| 21 | controller; |
| 22 | guide rail; |
| 23 | sliding device; |
| 24 | illumination assembly; |
| 25 | detection assembly; |
| 30 | illumination line; |
| 40 | parking area; |
| 50 | vehicle; |
| 100 | parking area; |
| 200A | horizontal lane; |
| 200B | longitudinal lane; |
| 241 | light source; |
| 242 | light shade; |
| 243 | light adjustment mechanism; |
| 243A | width baffle; |
| 243B | length baffle. |

DETAILED DESCRIPTION

The following embodiments serve to illustrate the disclosure, but are not intended to limit the scope of the disclosure. Without conflict, embodiments in the present disclosure and features in the embodiments may be combined with each other arbitrarily.

Figure 1:
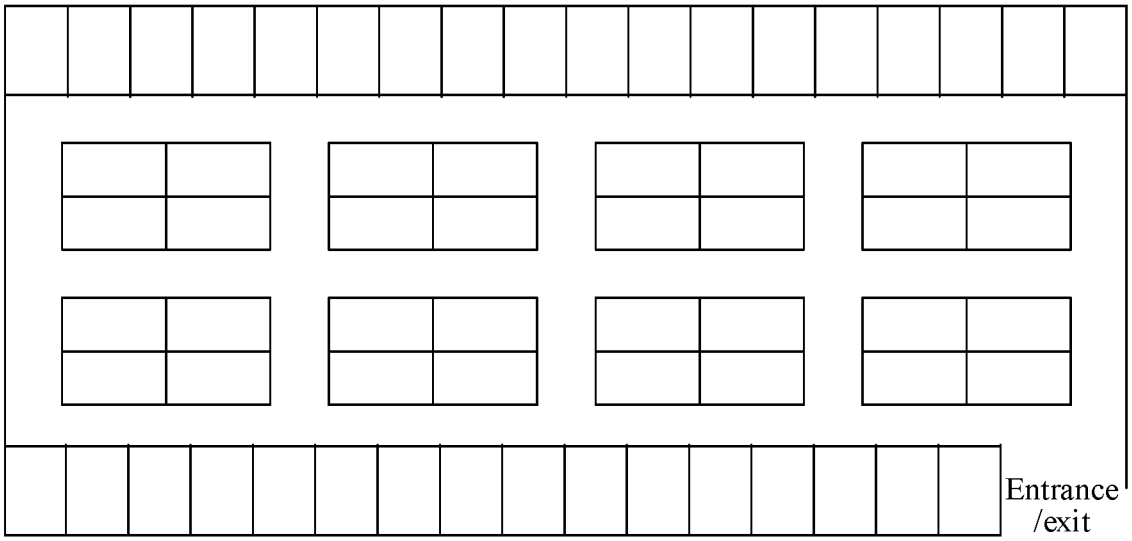
FIG. 1 is a schematic diagram of parking spaces in a parking lot.

Although a main reason for parking difficulty is the small number of parking lots, but low space utilization rate of a parking lot caused by parking pot management is also one of the important reasons for parking difficulty. As shown in FIG. 1, parking spaces are usually designed with uniform specifications, that is, all parking spaces have the same width. However, because vehicle body width of each vehicle model is greatly different, there is greater spare space exists when parking spaces are used by vehicles with smaller size, and when parking spaces are used by vehicles with larger size, adjacent parking spaces are often occupied due to tight space. Therefore, the design of the kind of equal-width parking space as shown in FIG. 1 will cause greater space waste, resulting in low space utilization rate of a parking lot. In addition, parking space boundary lines of a parking space are usually made of coatings with the properties of paints, but this kind of boundary line is easy to be worn. When serious abrasion occurs, not only the boundary lines need to be spray-coated again, which increases a maintenance cost, but also parking efficiency and quality of a driver are affected because the boundary lines cannot be seen clearly, resulting in that a vehicle can not be accurately parked in a parking space, and even it appears that one vehicle occupies two parking spaces. In fact, even if the boundary line is not worn, dimmer lighting of garages, accumulated water on the ground, or other situations also cause fuzzy or unclear boundary lines, so as to affect parking efficiency and quality of the driver as well and result in low space utilization rate of the parking lot.

Therefore, the present disclosure proposes a parking management scheme, capable of improving utilization rate of a parking lot so that more vehicles can be parked in a limited parking space.

Figure 2:
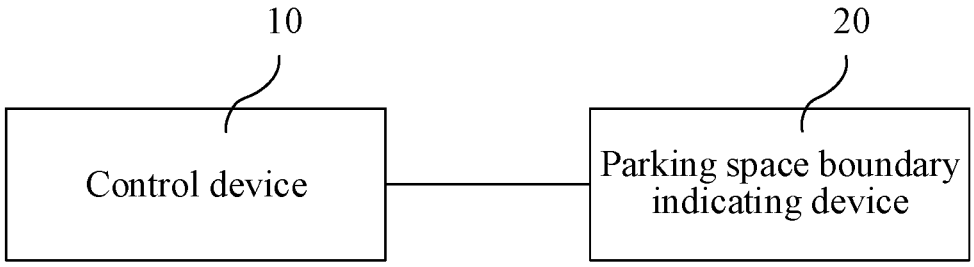
FIG. 2 is a schematic diagram of a structure of a parking management system according to an embodiment of the present disclosure.

FIG. 2 is a schematic diagram of a structure of a parking management system according to an embodiment of the present disclosure. As shown in FIG. 2, a parking management system of the embodiment of the present disclosure includes a control device 10 and a parking space boundary indicating device 20. Herein the control device 10 is configured to acquire size information of a vehicle to be parked and information of a vacant area where no vehicle is parked in a parking lot, determine parking area information of the vehicle to be parked according to the size information of vehicle to be parked and the information of the vacant area, and send the determined parking area information to the parking space boundary indicating device 20. The parking space boundary indicating device 20 is connected with the control device 10, and is configured to receive the parking area information sent by the control device 10, to form parking space boundary lines by shedding light on the parking area according to the parking area information.

The embodiment of the disclosure provides a parking management system, which configures size of a parking space according to an actual size of a vehicle, and forms parking space boundary lines via utilizing light illumination, thus not only space waste caused by a design of parking spaces with equal width is avoided, but also the situation that the parking space boundary lines affect parking efficiency and quality of a driver will not occur, so as to improve intelligent management level of the parking lot, and effectively increase the space utilization rate of the parking lot, so that more vehicles can be parked to the maximum extent in the limited parking space.

Figure 3:
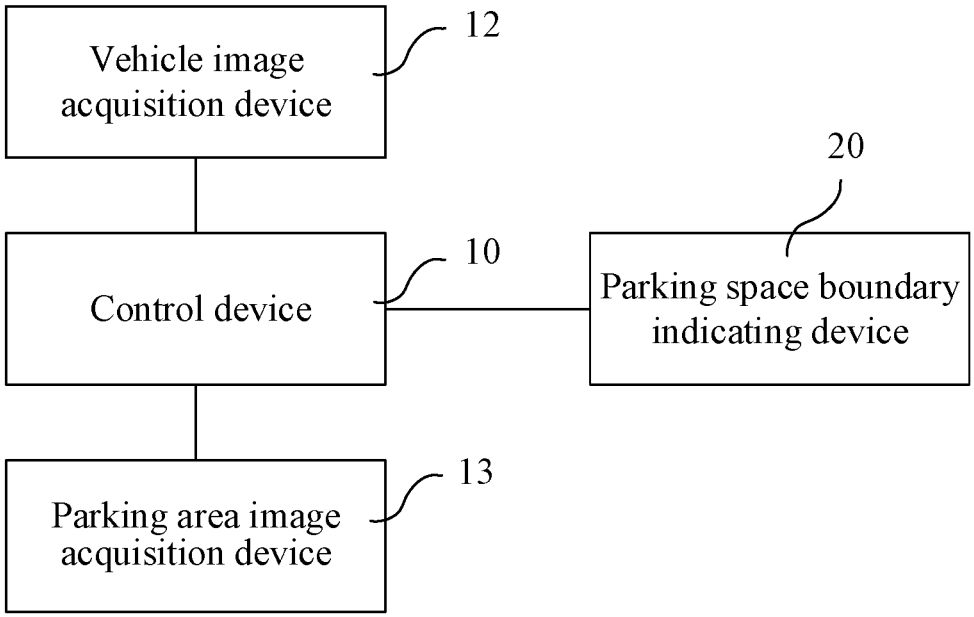
FIG. 3 is a schematic diagram of a structure of a parking management system according to another embodiment of the present disclosure.

FIG. 3 is a schematic diagram of a structure of another parking management system according to an embodiment of the present disclosure. As shown in FIG. 3, the parking management system further includes a vehicle image acquisition device 12 and a parking area image acquisition device 13. Herein the vehicle image acquisition device 12 is connected with the control device 10, and is configured to acquire a vehicle image information of a vehicle to be parked and send the vehicle image information to the control device 10; the parking area image acquisition device 13 is connected with the control device 10, and is configured to acquire parking area image information of a parking area in the parking lot and send the parking area image information to the control device 10; the control device 10 is configured to receive the vehicle image information sent by the vehicle image acquisition device 12 and the parking area image information sent by the parking area image acquisition device 13. Through image processing, the control device 10 is configured to acquire size information (for example, vehicle width, vehicle length or vehicle length and width) of the vehicle to be parked from the vehicle image information, acquire information of a vacant area where no vehicle is parked in a parking lot from the parking area image information, thereafter determine parking area information of the vehicle to be parked according to the acquired vehicle size information and the information of the vacant area of the parking lot, and send the determined parking area information to the parking space boundary indicating device 20.

In an embodiment of the present disclosure, the vehicle image acquisition device 12 may adopt an image acquisition device such as a camera or a video camera. When the vehicle to be parked enters the parking lot, the camera captures a vehicle image of the vehicle to be parked in real time and sends the vehicle image to the control device 10. After receiving the vehicle image, the control device 10 acquires a size (for example, including width, length, length and the width of the vehicle, or in addition, including the height of the vehicle) of the vehicle to be parked by performing image processing on the vehicle image. The parking area image acquisition device 13 may adopt a camera, which captures parking area images of each parking area in the parking lot at regular time, and sends the parking area images to the control device 10. After receiving the parking area images, the control device 10 acquires information of one or more vacant areas in the parking lot where no vehicle is parked by performing image processing on the parking area image. Herein the information of the vacant area includes the position and size of the vacant area (for example, including length, width, length and width of the vacant area, or in addition, including height of the vacant area). Then, the control device 10 selects a parking area suitable for parking the vehicle in the one or more vacant areas according to preset parking strategy. Finally, the control device 10 sends the determined parking area information to the parking space boundary indicating device 20. For example, the parking area information may include position and size of the parking area (for example, including length, width, or length and width of the parking area).

Figure 4:
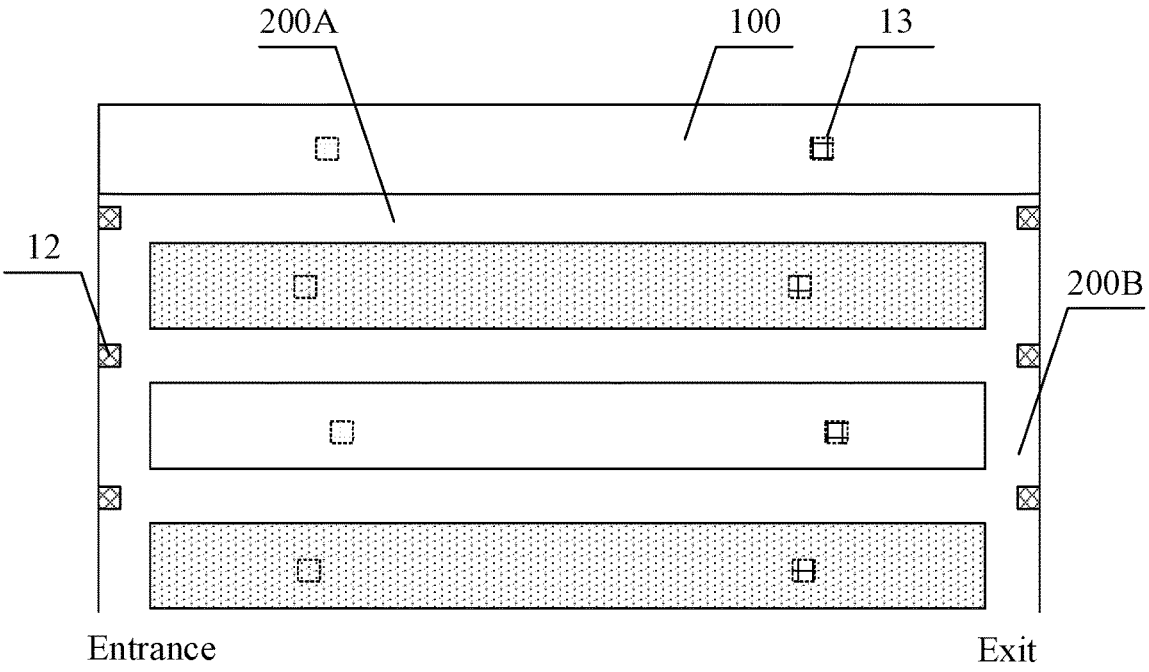
FIG. 4 is a schematic diagram of a position of an image acquisition device according to an embodiment of the present disclosure.

FIG. 4 is a schematic diagram of a position of an image acquisition device according to an embodiment of the present disclosure. As shown in FIG. 4, the parking lot is rectangular, four parking areas (areas filled with dot patterns) 100 are disposed, each parking area 100 is a row of rectangles without parking space boundary lines, transverse lanes 200A are formed between adjacent parking areas 100, longitudinal lanes 200B are formed between the parking areas 100 and side boundaries of the parking lot, and an entrance and an exit are disposed at the end of the longitudinal lane 200B. Because the design is mainly based on transverse lanes, and an occupied area of the lanes is small, it is beneficial to increase the area of a parking area. Under this parking lot layout, a vehicle image acquisition device 12 can be disposed on a side wall at the end of the transverse lane 200A, and the vehicle image acquisition device 12 captures a vehicle image in real time after the vehicle enters the transverse lane 200A of the parking lot. In this embodiment, induction devices, such as electromagnetic induction devices or pressure sensors, can be buried at the ground of the transverse lane 200A. When it is sensed that a vehicle is passing by, a trigger signal is sent to the vehicle image acquisition device 12 of the lane where the vehicle is located, and the vehicle image acquisition device 12 that receives the trigger signal captures the vehicle located on the transverse lane 200A. The parking area image acquisition device 13 can be disposed right above the parking area 100, such as the top wall of the parking lot, and regularly captures images of the parking area 100. Regular capturing refers to periodical capturing according to a set time interval (such as a few minutes). In this embodiment, there may be a plurality of vehicle image acquisition devices 12, and the vehicle image acquisition devices 12 are disposed on side walls at an end(s) of each transverse lane 200A, to improve the accuracy of vehicle image acquisition. In addition, there may be a plurality of parking area image acquisition devices 13, and one or more parking area image acquisition devices 13 are disposed on top walls of the upper part of each parking area 100, to improve the accuracy of parking area image acquisition.

Of course, positions of the vehicle image acquisition devices and the parking area image acquisition devices disposed in this embodiment are only examples. In other embodiments, the vehicle image acquisition devices may be disposed on the walls at an end(s) of the longitudinal lane, on the walls at both ends of the transverse lane and on the walls at an end(s) of the longitudinal lane, or at other positions, such as an entrance of the parking lot. In addition, the vehicle image acquisition device and the parking area image acquisition device may adopt a camera that captures a vehicle video image, which is not limited herein in the present disclosure.

After receiving the vehicle image sent by the vehicle image acquisition devices 12, the control device 10 performs image processing on the vehicle image to acquire a size of the vehicle, such as width. For example, the vehicle image is firstly processed by cutting, graying, filtering and binarization to reduce data processing amount, and then a reference object and a quantity of the pixels of the vehicle are calculated respectively, so that width information of the vehicle can be obtained according to width of the reference object. In this embodiment, after receiving the parking area image, the control device 10 performs image processing on the parking area image to acquire the information of the vacant area where no vehicle is parked. For example, firstly, the parking area images transmitted from each parking area image acquisition device 13 are combined, to form a panoramic image including all parking areas, then the panoramic image is processed by cutting, graying, filtering and binarization, finally, boundary extraction technology is adopted to determine occupied areas of vehicles. The area except for the area occupied by the vehicle is the vacant area where no vehicle is parked, and the information of the vacant area includes the position and size of the vacant area. In other embodiments, application software such as Open Source Computer Vision Library (opencv) can be adopted so as to achieve image processing to acquire the vehicle size and the information of the vacant area.

After acquiring the vehicle size and the information of the vacant area, the control device 10 may select the parking area information suitable for parking the vehicle in the vacant area according to the vehicle size, the information of the vacant area and the preset parking strategy. For example, the parking area information may include the position and size of the parking area. Herein the preset parking strategy can be: in a parking area, the vehicle is preferentially parked at a position near the entrance, so that the vehicles are sequentially arranged in a direction from the entrance to the exit; and the vehicle is preferentially parked at the edge of the vacant area, so that the selected parking area is close to the parked vehicle, so as to save space to the greatest extent. Herein the processing of the determination of the parking area may include: firstly determining the parking area according to the size of the vehicle, selecting a position of the parking area according to the parking strategy, then judging whether the size of the vacant area of this position is larger than the size of the parking area, if yes, determining that the vacant area is a parking area, and sending the parking area information to the parking space boundary indicating device 20, and if not, re-selecting until the parking area is determined.

For example, regarding the distance from a vehicle head to a vehicle tail as the length of the vehicle, and regarding the distance between the two sides of the vehicle as the width of the vehicle, the selection of the parking area above according to the vehicle size information and the information of the vacant area may be, for example, any of the following situations:

Case 1: according to the width of the vehicle and the width of the vacant area, the position and the width of the parking area where the vehicle can be parked are determined; for example, if the parking area is designed in such a manner that the vehicles are adjacently parked side by side, whether the vehicle can be parked at the vacant area is calculated according to the width of the vehicle and the width of the vacant area (referred to the distance from the side edge of the parked vehicle to the boundary of the parking area). If yes, the area where the vehicle can be parked is the parking area, and the width of the parking area is slightly larger than that of the vehicle, so as to leave the distance for opening a vehicle door;

Case 2: according to the length of the vehicle and the length of the vacant area, the position and the length of the parking area where the vehicle can be parked are determined; for example, if the parking area is designed in such a manner that the vehicles are adjacently parked in a head-to-tail manner, whether the vehicle can be parked at the vacant area is calculated according to the length of the vehicle and the length of the vacant area (referred to the distance from the head or tail of the parked vehicle to the boundary of the parking area). If yes, the area where the vehicle can be parked is the parking area, and the length of the parking area is slightly larger than that of the vehicle, so as to leave the required distance for turning when the vehicle leaves the parking space;

Case 3: according to the length and the width of the vehicle and the length and the width of the vacant area, the position, the length and the width of the parking area where the vehicle can be parked are determined; for example, whether or not the vehicle can be parked and how to park it can be calculated according to the length and the width of the vehicle and the length and the width of the vacant area. If yes, the position, the length and the width of the parking area can be determined according to the calculation results. The length of the parking area is slightly larger than the length of the vehicle. For example, it meets a requirement of people to open a trunk for stuff taking and placement (when the vehicles are adjacently parked side by side) or to leave the required distance for turning when the vehicle leaves the parking space (when the vehicles are adjacently parked in a head-to-tail manner). The width of the parking area is slightly larger than the width of the vehicle, and at least it can meet a requirement of people to open a vehicle door to get on or get off.

When the parking lot is an indoor parking lot, the height of the vehicle can also be considered. For example, the height of somewhere in the parking area is smaller, and when it is judged that the length, the width and the height of the vehicle driven into the parking lot satisfy the size requirement of the parking area according to the length, the width and the height of the parking area, the parking space boundary indicating device is used to instruct the position and size of the parking area and guide a driver to park the vehicle in the parking area through the instruction.

The above situations are only examples, and are not exhaustion of all possibilities. In other embodiments, referring to the above implementation, there may be other implementations.

After a vehicle leaves the parking lot, the length and the width of a vacant parking space can be calculated according to a scene image. When the vehicle driven into the parking lot can be parked into the parking space, a driver is guided to park the vehicle in the vacant parking space by the instruction (such as a cursor).

The control device 10 can include a processor and a memory. Herein the processor can be a chip with a computing function such as a CPU (Central Processing Unit), an MCU (Microcontroller Unit) or an FPGA (Field-Programmable Gate Array). The memory may be, for example, a magnetic disk, a ROM (Read-Only Memory), a RAM (Random Access Memory), or any combination thereof, and is used for storing the programs executed by the processor.

Figure 5:
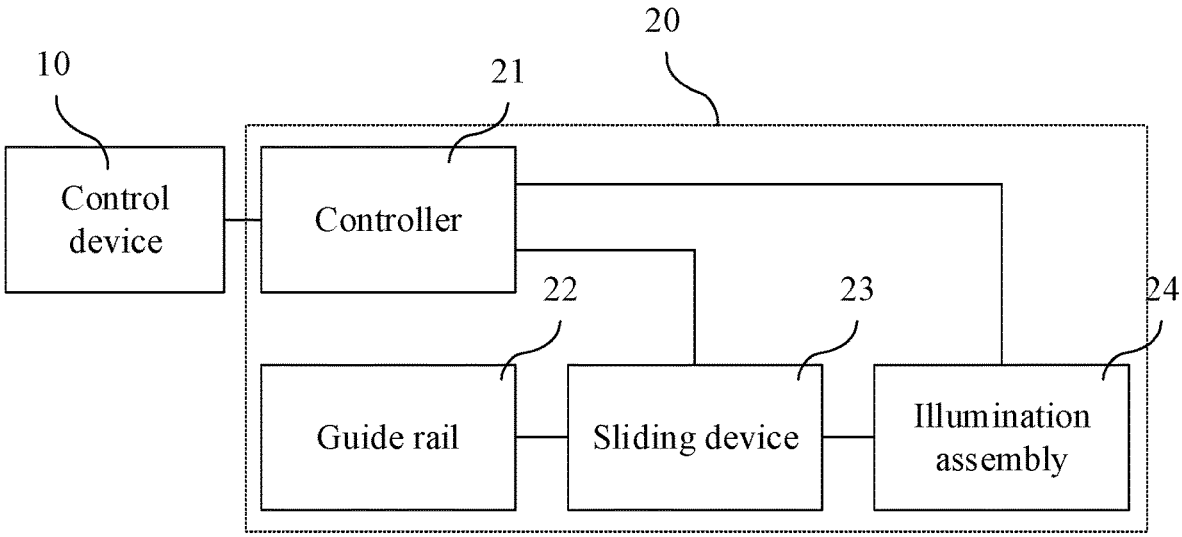
FIG. 5 is a schematic diagram of a structure of a parking space boundary indicating device according to an embodiment of the present disclosure.

FIG. 5 is a schematic diagram of a structure of a parking space boundary indicating device according to an embodiment of the present disclosure. As shown in FIG. 5, the parking space boundary indicating device 20 includes a controller 21, a guide rail 22, a sliding device 23 and an illumination assembly 24. The controller 21 is respectively connected with the sliding device 23 and the illumination assembly 24. Herein, the guide rail 22 is disposed above each parking area; the sliding device 23 is slidably disposed on the guide rail 22 and configured to slide to the parking area under the instruction of the controller 21; and the illumination assembly 24 is disposed on the sliding device 23 and configured to move under the driving of the sliding device 23, shed light under the instruction of the controller 21, and form parking space boundary lines from light in the parking area. The controller 21 is electrically connected with the control device 10 of the parking management system, is electrically connected with the sliding device 23 and the illumination assembly 24, receives the parking area information sent by the control device 10, determines the position and size (such as width) of the parking space boundary lines formed by the illumination assembly 24 according to the parking area information, instructs the sliding device 23 to slide to the position of the parking area, and instructs the illumination assembly 24 to shed light to form parking space boundary lines from light on both sides of or around the parking area.

The control device 10 determines the parking area information of the vehicle to be parked, and sends the parking area information to the controller 21. For example, any of the following ways can be included:

In the first mode, after determining the position and size of the parking area of the vehicle to be parked according to the size information of the vehicle to be parked and the information of the vacant area, the control device 10 converts the position and size (such as width) of the parking area into the instruction information for the parking space boundary indicating device, i.e., the parking area information at this time may include the instruction information for instructing to shed light to form the parking space boundary lines. Taking the parking space boundary indicating device 20 including a controller 21, a guide rail 22, a sliding device 23, and an illumination assembly 24 as an example, the parking area information includes the instruction information indicating the sliding direction and sliding distance (or sliding time) of the sliding device 23 and the instruction information instructing the illumination assembly to emit light for example. According to the instruction information, the controller 21 sends movement and stopping instructions to the sliding device 23 and sends instructions to turn on and turn off the light source to the illumination assembly 24.

In the second mode, after determining the position and size of the parking area of the vehicle to be parked according to the size information of the vehicle to be parked and the information of the vacant area, the control device 10 sends the parking area information including the position and size of the parking area to the controller 21, then the controller 21 calculates the sliding direction and sliding distance (or sliding time) of the sliding device, sends movement and stopping instructions to the sliding device 23, and sends instructions to turn on and turn off the light source to the illumination assembly 24.

For example, the controller 21 can be implemented by adopting a single chip microcomputer.

Figure 6:
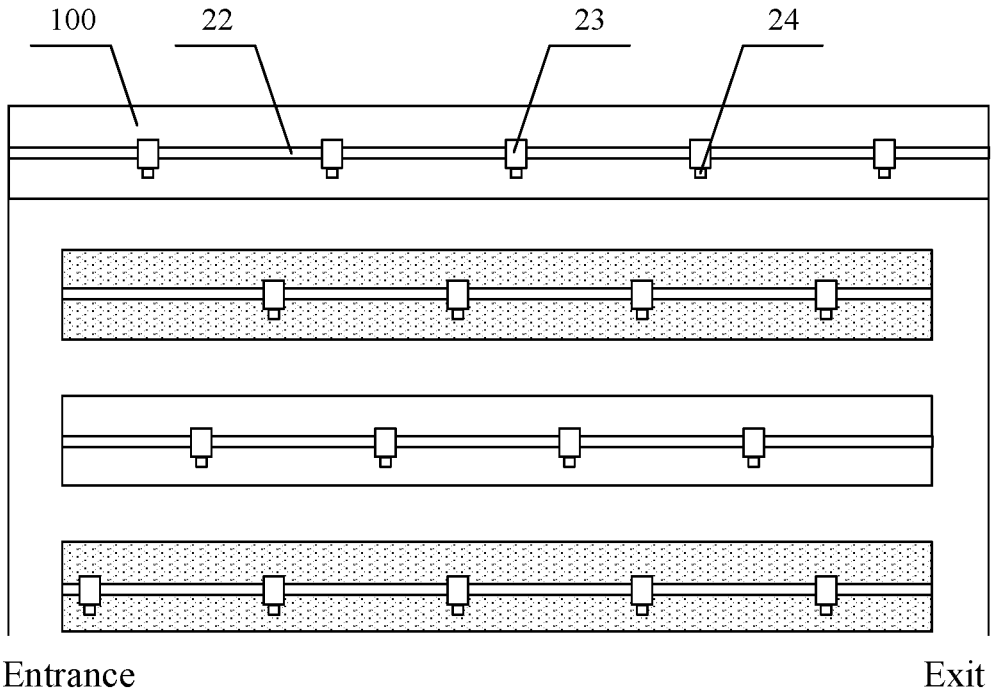
FIG. 6 is a schematic diagram of a position of a parking space boundary indicating device according to an embodiment of the present disclosure.

FIG. 6 is a schematic diagram of a position of a parking space boundary indicating device according to an embodiment of the present disclosure. As shown in FIG. 6, the number and position of guide rail 22 correspond to the number and position of parking area 100, and each guide rail 22 is disposed directly above each parking area 100, such as a top wall of a parking lot. The quantity of sliding devices 23 disposed on each guide rail 22 corresponds to the quantity of vehicles expected to be parked in the parking area 100 below the guide rail 22. The quantity of illumination assembly 24 corresponds to the quantity of sliding device 23, and the illumination assembly 24 is disposed at the lower part of the sliding device 23.

In the embodiment of the present disclosure, the guide rail 22 and the sliding device 23 can be designed with corresponding transmission modes according to the parking lot environment, such as lead screw drive or belt drive, so as to achieve the free and smooth movement of a plurality of sliding devices 23 on the guide rails 22. In this embodiment, a driving motor is disposed on the sliding device 23, and the sliding device 23 is driven by the driving motor to slide on the rail. The driving motor is electrically connected with the controller 21, and the driving motor rotates under the control of the controller 21. The driving motor can be a stepping motor; and the controller 21 outputs pulse signals to the driving motor, and controls the moving distance of the sliding device 23 according to the rotation angle of each pulse driving motor, thereby achieving the positioning of the illumination assembly 24. For example, the driving motor can be disposed on the guide rail 22 which includes a rail and the driving motor. The sliding device 23 is disposed on the rail and connected with the driving motor through a transmission device, and the driving motor drives the sliding device 23 to slide on the rail. In addition, an ultrasonic transmitting and receiving device can also be disposed on each sliding device 23, and the distance between adjacent sliding devices 23 can be determined by ultrasonic transmitting and receiving to prevent collision.

Figure 7:
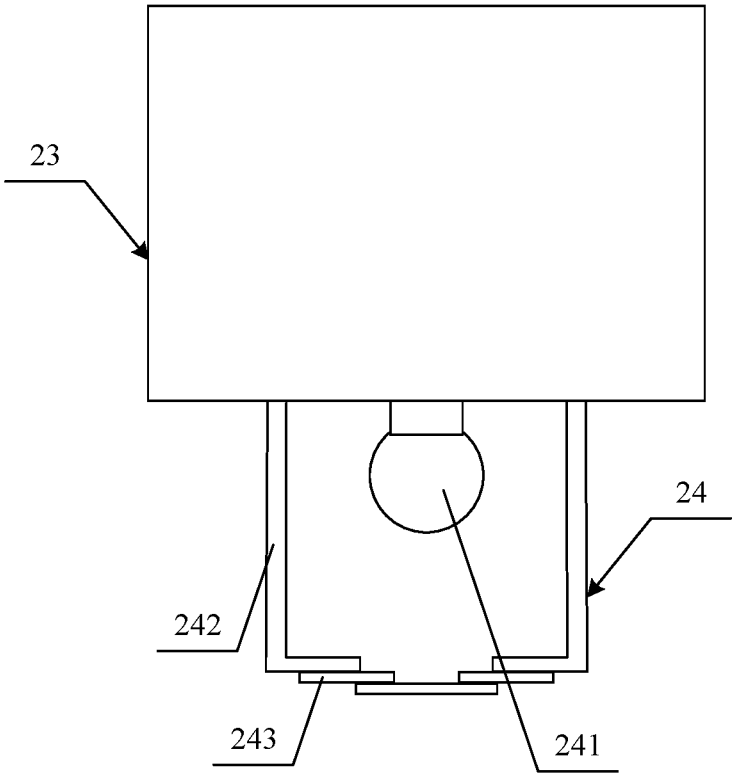
FIG. 7 is a schematic diagram of a structure of an illumination assembly according to an embodiment of the present disclosure.

FIG. 7 is a schematic diagram of a structure of an illumination assembly according to an embodiment of the present disclosure. As shown in FIG. 7, the illumination assembly 24 includes a light source 241, a light shade 242 and a light adjustment mechanism 243. The light source 241 is disposed in the light shade 242, the light shade 242 is connected to the lower part of the sliding device 23, and the light adjustment mechanism 243 is disposed at the light outlet of the light shade. Herein, the light source 241 may be a point light source, such as an LED lamp bead, which is controlled by the controller 21 to continuously or intermittently emit striking light. The light shade 242 can be made of an opaque material, and its inner surface can be spray-coated with a reflective material to reduce light loss. The light adjustment mechanism 243 is configured to adjust the shape of the illumination pattern formed on the ground by changing the shape of the light outlet.

Figure 8:
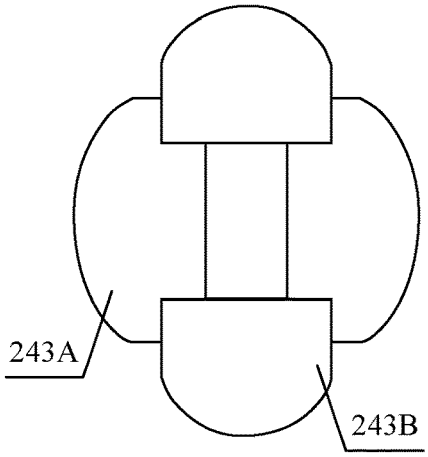
FIG. 8 is a schematic diagram of a structure of a light adjustment mechanism according to an embodiment of the present disclosure.

FIG. 8 is a schematic diagram of a structure of a light adjustment mechanism according to an embodiment of the present disclosure. As shown in FIG. 8, the light adjustment mechanism 243 includes a pair of width baffles 243A and a pair of length baffles 243B, and the pair of width baffles 243A and the pair of length baffles 243B can move in the plane of the light outlet at the bottom of the light shade 242, to form a rectangular opening. Because of a larger length-width ratio, the rectangular opening is similar to a linear hole. A pair of width baffles 243A can move along the width direction of the rectangular opening, to adjust the width of the rectangular opening and further adjust the width of the parking space boundary lines formed by light illumination on the ground; and a pair of length baffles 243B can move along the length direction of the rectangular opening, to adjust the length of the rectangular opening and further adjust the length of the parking space boundary lines formed by light illumination on the ground. In this way, by adjusting the position of the baffles, the actual size of the rectangular opening is adjusted accordingly, and the purpose of adjusting the size of the parking space boundary lines on the ground is achieved. In the installation process, the baffles can be adjusted manually according to the actual parking lot environment. In an exemplary embodiment, the light adjustment mechanism 243 may adjust the shape of the parking space boundary lines formed on the ground according to the instruction of the controller 21, for example, the width baffles 243A and/or the length baffles 243B are moved according to the instruction of the controller.

Figure 9:
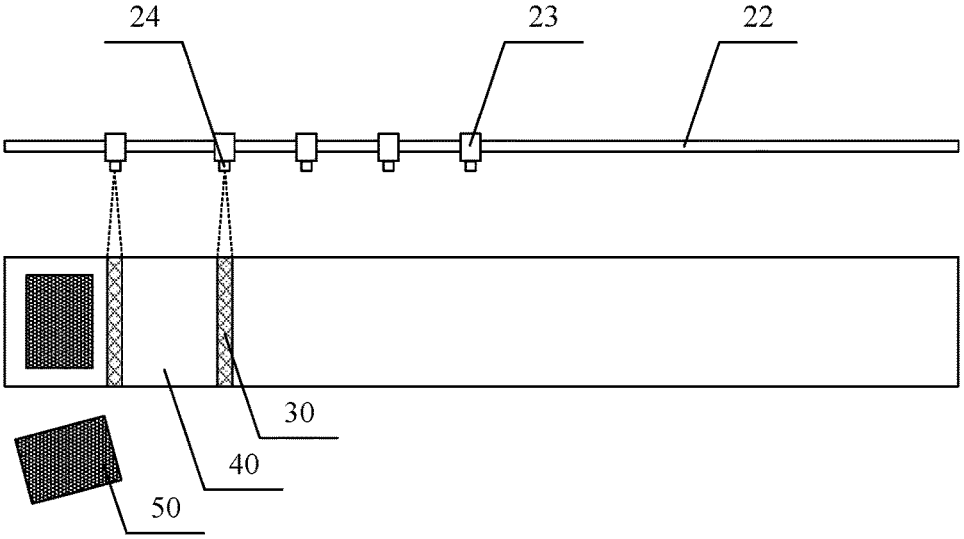
FIG. 9 is a schematic diagram of a parking space boundary line formed by a parking space boundary indicating device according to an embodiment of the present disclosure.

FIG. 9 is a schematic diagram of a parking space boundary line formed by a parking space boundary indicating device according to an embodiment of the present disclosure. As shown in FIG. 9, in this embodiment, the light emitted by each illumination assembly 24 forms a rectangular illumination pattern on the ground. When the length-width ratio of the rectangle is large, the illumination pattern is similar to an illumination line 30. Parking space boundary lines suitable for a vehicle size (e.g., width) includes two illumination lines 30 formed by two adjacent illumination assemblies 24, a parking area 40 is formed between the two illumination lines 30, and the driver may be instructed to park the vehicle 50 in this area.

Figure 10:
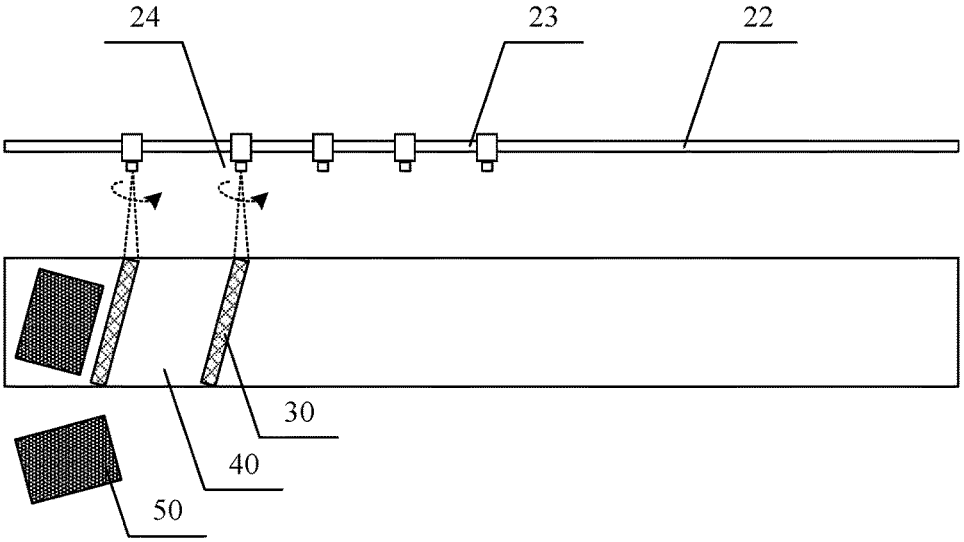
FIG. 10 is a schematic diagram of another parking space boundary line formed by a parking space boundary indicating device according to an embodiment of the present disclosure.

FIG. 10 is a schematic diagram of another parking space boundary line formed by a parking space boundary indicating device according to an embodiment of the present disclosure. In this embodiment, the illumination assembly 24 is movably connected with the sliding device 23 through a hinging mechanism, and the illumination assembly 24 can rotate around its central axis, thereby controlling the angle of the formed illumination line. As shown in FIG. 10, through the rotation of the illumination assembly 24, the light emitted by each illumination assembly 24 forms inclined illumination lines 30 on the ground, and the area between the two inclined illumination lines 30 serves as a parking area 40 for parking a vehicle 50. The inclined parking area 40 is more convenient for the vehicle to enter or leave.

The above description only takes the formation of two parking space boundary lines on both sides of the vehicle as an example. In other embodiments, two parking space boundary lines on the front and rear sides of the vehicle can be formed, or four parking space boundary lines around the vehicle can be formed. The parking space boundary lines can be formed by referring to the formation mode of the above two parking space boundary lines, with the difference that the positions or numbers of the above devices and assemblies may be various.

It can be seen from the above description that, on the one hand, the embodiment of the disclosure acquires the size information of the vehicle to be parked through the vehicle image acquisition device, and selects the appropriate parking area according to the vehicle size and the preset parking strategy, thus achieving the allocation of a parking space size according to the actual size of the vehicle, and avoiding space waste caused by the design of parking spaces with equal width. On the other hand, the embodiment of the disclosure uses the illumination assembly to form the parking space boundary lines suitable for the size of the vehicle in the parking area, thus avoiding abrasion and blurring of the parking space boundary lines made of paint and improving the parking efficiency and quality of a driver. Therefore, the embodiment of the disclosure effectively improves the space utilization rate of a parking lot, and more vehicles can be parked in the limited parking space to the maximum extent.

Figure 11:
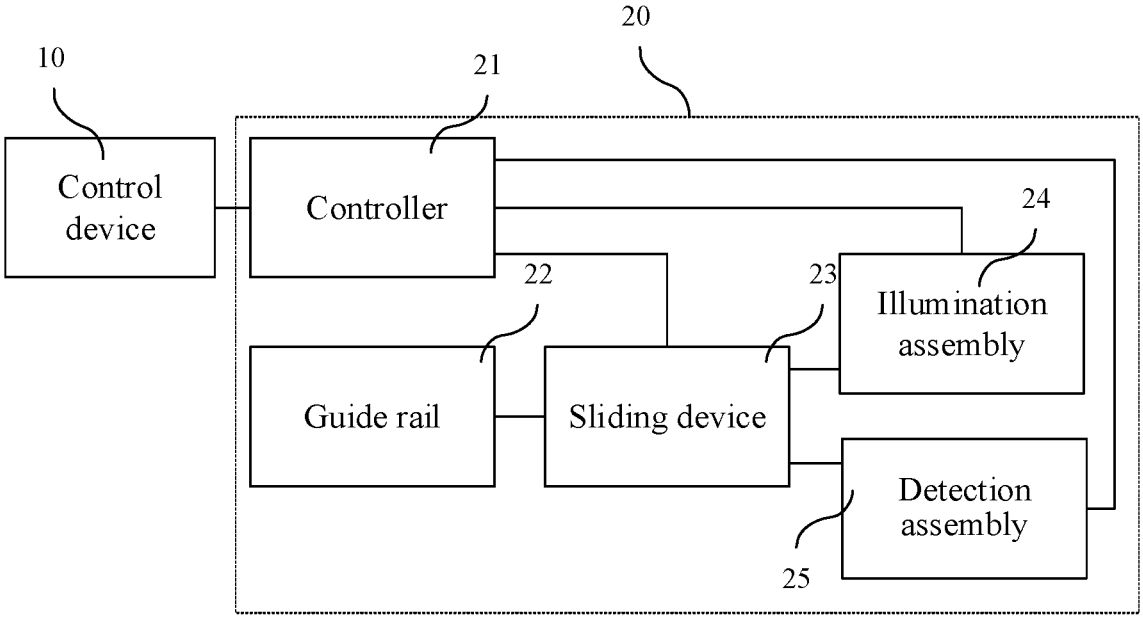
FIG. 11 is a schematic diagram of a structure of another parking space boundary indicating device according to an embodiment of the present disclosure.

FIG. 11 is a schematic diagram of a structure of another parking space boundary indicating device according to an embodiment of the present disclosure, and is a solution extension of the embodiment shown in the above FIG. 5. As shown in FIG. 11, a parking space boundary indicating device 20 of this embodiment not only includes a controller 21, a guide rail 22, a sliding device 23 and an illumination assembly 24, but also includes a detection assembly 25, which can be a camera device disposed on the sliding device 23, and configured to photograph a vehicle being parked and transmit a photographed image to the controller 21. The controller 21 receives the image from the detection assembly 25, judges whether the vehicle exceeds the parking space boundary lines according to the image, and sends out a warning signal when a judgment result is that the being currently parked vehicle exceeds the parking space boundary lines. Herein, the warning signal can be a voice broadcast, or the flashing of the illumination assembly 24, so as to remind the driver to adjust the parking position of the vehicle. In other embodiments, the above judgment operation can be performed by the detection assembly 25, for example, the detection assembly 25 completes photographing, judgment and warning operations. The processing of judging whether the vehicle exceeds the parking space boundary lines can be achieved by judging whether the light emitted by the illumination assembly 24 is blocked, and when the light emitted by the illumination assembly 24 is blocked, it is judged that the vehicle exceeds the parking space boundary lines. In this embodiment, by arranging the detection assembly, a manager of the parking lot may be replaced to guide the driver to park the vehicle in the parking area, thus avoiding the situation that multiple parking spaces are occupied by irregular parking, improving the space utilization rate of the parking lot and reducing the management cost of the parking lot.

Figure 12:
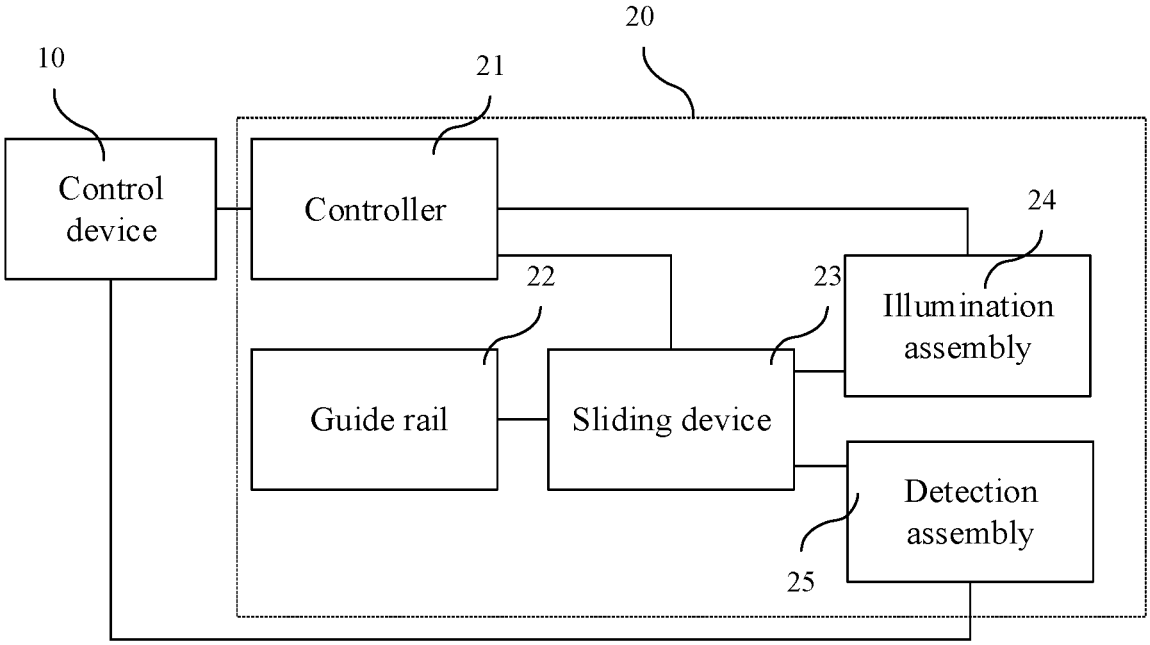
FIG. 12 is a structural schematic diagram of another parking space boundary indicating device according to an embodiment of the present disclosure.

In an exemplary embodiment, as shown in FIG. 12, the detection assembly 25 may transmit the photographed image to the control device 10; and the control device 10 judges whether the vehicle exceeds the parking space boundary lines according to the image, and instructs the controller 21 to send a warning signal when a judgment result is that the being currently parked vehicle exceeds the parking space boundary lines. For example, the control device 10 instructs the controller 21 to control the illumination assembly 24 to send an illumination warning signal, or control a voice playing device to play a voice alarm.

In the following, by taking the vehicles being adjacently parked side by side as a example, the technical solution of the embodiment of the present disclosure will be explained through the parking process of the vehicle.

After the vehicle enters a parking garage, when a sensor device buried on the ground of the transverse lane senses that the vehicle passes by, it sends a trigger signal to the vehicle image acquisition device in the lane where the sensor is located, and the vehicle image acquisition device disposed at the end of the transverse lane photographs the vehicle and sends the vehicle image to the control device. In addition, the control device regularly receives the parking area image sent by the parking area image acquisition device.

After receiving the vehicle image and parking area image, the control device acquires vehicle width and the information of the vacant area through image processing, and determines the parking area suitable for parking the vehicle according to the vehicle width, the information of the vacant area and the preset parking strategy.

After the parking area is determined, the control device sends the parking area information to the parking space boundary indicating device, and the parking area information includes the position and width of the parking area.

After receiving the parking area information, the controller of the parking space boundary indicating device controls two corresponding sliding devices to slide on the guide rail according to the position and width of the parking area, and drives the two illumination assemblies to move to the position where the parking area is located. In addition, the distance between the two illumination assemblies is equal to the width of the parking area.

After the illumination assemblies move to the position of the parking area, the controller controls the two illumination assemblies to start flashing to indicate the parking area for the driver.

When the vehicle is close to the parking area (e.g., 2 m-3 m from the parking area), the controller controls the two illumination assemblies to stop flashing and keep them in on-state. The two illumination assemblies generate two illumination lines on the ground as the parking space boundary lines, and a parking area is formed between the two illumination lines, for instructing the driver to park the vehicle in the area.

During the driver parks the vehicle, the detection assembly disposed on the sliding device detects whether the vehicle exceeds the illumination lines, and when the vehicle exceeds the illumination lines, a warning signal is sent out to remind the driver to adjust the parking position of the vehicle.

The subsequent processing after the vehicle is parked can be designed according to the actual environment of the parking lot, which is not limited here in this embodiment. For example, the illumination lines, as the parking space boundary lines, may remain on-state until the control device recognizes that the vehicle leaves. For another example, after the vehicle is parked, the illumination lines as the parking space boundary lines are turned off immediately, etc.

Through the above process, not only it is achieved that the parking area suitable for the vehicle size is selected according to the vehicle size, but also it is achieved that the parking space boundary line suitable for the vehicle size is formed in the parking area by the illumination assembly. Small parking areas are allocated to vehicles with smaller size, and large parking areas are allocated to vehicles with larger size, thus avoiding waste of space caused by the design of parking spaces with equal width and the unavailability of adjacent parking spaces. In addition, the illumination lines are adopted as the parking space boundary lines, thus, abrasion problems do not exist, maintenance cost is reduced, and illumination lines are obvious and clear, therefore, the parking efficiency and quality of the driver are improved. To sum up, with the parking management system provided by the embodiment of the disclosure, not only large space waste caused by the design of parking spaces with equal width is avoided, but also the problem that the parking space boundary lines made of paint affecting the parking efficiency and quality of the driver is avoided, and the problems such as abrasion and blurring of parking space boundary lines made of paint and the like are avoided, therefore, the intelligent management level of a parking lot is improved, and the space utilization rate of the parking lot is increased effectively, so that more vehicles can be parked in limited parking spaces to a maximum extent, thus greatly alleviating the current situations of parking difficulties. The parking management system provided by the embodiment of the disclosure has simple structure, low utilization cost of unit space, simple operation, easy implementation and good application prospect.

In an exemplary embodiment, an embodiment of the present disclosure provides a parking management method. The parking management method of the embodiment of the disclosure includes:

S1, acquiring the size information of the vehicle to be parked and the information of the vacant area where no vehicle is parked in a parking lot;

S2, determining the parking area information of the vehicle to be parked according to the size information of the vehicle to be parked and the information of the vacant area;

S3, forming parking space boundary lines by shedding light on the parking area.

Herein, step S1 may include:

acquiring the vehicle image of a vehicle to be parked and the parking area image of a parking area in a parking lot, respectively;

through image processing, acquiring the size information of the vehicle to be parked from the vehicle image, and acquiring the information of the vacant area from the parking area image.

Herein, step S2 may include:

determining a parking area suitable for parking the vehicle according to the size information of the vehicle to be parked, the information of the vacant area and a preset parking strategy; the preset parking strategy includes: in a parking area, the vehicle is preferentially parked at a position near the entrance and preferentially parked at the edge position of the vacant area.

Herein, the information of the vacant area includes the position and size of the vacant area, and the parking area information includes the position and size of the parking area. In other embodiments, the parking area information may include the instruction information for instructing to shed light to form parking space boundary lines. The implementation is described in the above embodiments, and will not be repeated in detail here.

Herein, after step S3, the parking management method further includes: judging whether a vehicle being parked exceeds the parking space boundary lines, and sending out a warning signal when the vehicle exceeds the parking space boundary lines.

Herein, step S3 may include:

receiving the parking area information;

according to the parking area information, instructing the illumination assembly to slide to the parking area;

and instructing the illumination assembly to shed light, and forming parking space boundary lines from light in the parking area.

Via the parking management method provided by the embodiment of the disclosure, the parking space boundary lines are formed by light illumination, which not only avoids large space waste caused by the design of parking spaces with equal width, but also avoids the problem that the parking space boundary lines made of paint affect the parking efficiency and quality of the driver, improves the intelligent management level of the parking lot, and effectively improves the space utilization rate of the parking lot, so that more vehicles can be parked in the limited parking space to the maximum extent.

Embodiments of the present disclosure also provide a computer-readable storage medium storing executable instructions. The parking management method provided by any of the above embodiments of the present disclosure can be achieved when the executable instructions are executed by a processor. The parking management method can be used to control the parking management system provided by the above embodiments of the present disclosure to perform parking management, thereby improving the space utilization rate of a parking lot. The method for driving the parking management system to perform parking management by executing the executable instructions is basically the same as the parking management method provided in the above embodiments of this disclosure, and will not be repeated in detail here.

In the description of the present disclosure, it should be understood that an orientation or position relationship indicated by the terms "middle", "upper", "lower", "front", "rear", "vertical", "horizontal", "top", "bottom", "inner", "outer" and the like is based on the orientation or position relationship shown in the accompanying drawings, which is only for the convenience of describing the present disclosure and simplifying the description, rather than indicating or implying that the apparatus or element referred to must have the specific orientation, or be constructed and operated in the specific orientation, and thus cannot be interpreted as a limitation on the present disclosure.

In the description of the embodiments of present disclosure, unless otherwise clearly specified and defined, the terms "install", "connect" and "link" should be broadly interpreted, for example, it may be connected fixedly or connected detachably, or integrated, it may be a mechanical connection or an electrical connection, it may be directly connected, or may be indirectly connected through an intermediate medium, or an internal connection between two elements. Those of ordinary skill in the art can understand the specific meanings of the above mentioned terms in the present disclosure.

It should be understood by those skilled in the art that embodiments of the present disclosure may be provided as methods, systems, or computer program products. Therefore, the present disclosure may adopt the form of an entire hardware embodiment, an entire software embodiment, or an embodiment combining software and hardware aspects. Furthermore, the present disclosure may take the form of a computer program product implemented on one or more computer usable memory media (including but not limited to a magnetic disk memory, an optical memory, etc.) containing computer usable program codes therein.

The present disclosure is described with reference to flowcharts and/or block diagrams of methods, devices and computer program products according to embodiments of the present disclosure. It should be understood that each process in a flowchart can be implemented by computer program requests. These computer program requests may be provided to general-purpose computers, special-purpose computers, embedded-type processors or the processors of other programmable information processing devices to generate a machine, so that the functions implementing specified in one or more processes of the flowchart are generated through the requests executed by the computers or the processors of other programmable information processing devices.

These computer program requests may also be stored in a computer-readable memory that can guide a computer or other programmable information processing devices to work in a specific manner, so that the requests stored in the computer-readable memory produce manufactured goods including a requesting device, which implements the functions specified in one or more processes of the flowchart.

These computer program requests may also be loaded onto computers or other programmable information processing devices, so that a series of operation steps are executed on the computers or other programmable devices, to generate treatment achieved by computers, so that the requests executed on the computers or other programmable devices provide steps for implementing the functions specified in one or more processes in the flowchart.

Although implementations disclosed in the present disclosure are as the above, the described contents are only implementations used for facilitating understanding the present disclosure, and are not used to limit the present disclosure. Any person skilled in the art to which the present disclosure pertains may make any modifications and variations in the form and details of implementation without departing from the spirit and the scope of the present disclosure, but the protection scope of the present disclosure shall still be subject to the scope defined in the appended claims.

What we claim is:

1. A parking management system, comprising:

a control device and a parking space boundary indicating device, wherein the control device is configured to acquire size information of a vehicle to be parked and information of a vacant area where no vehicle is parked in a parking lot, determine parking area information of the vehicle to be parked according to the size information of the vehicle to be parked and the information of the vacant area, and send the parking area information to the parking space boundary indicating device; and the parking space boundary indicating device is connected with the control device, and configured to form parking space boundary lines by shedding light on a parking area according to the parking area information, wherein the parking space boundary indicating device comprises:

a guide rail, disposed above a parking area;

a sliding device, slidably disposed on the guide rail and configured to slide to the parking area under an instruction of a controller;

an illumination assembly, disposed on the sliding device and configured to shed light under the instruction of the controller, to form the parking space boundary lines from light in the parking area;

the controller, electrically connected with the control device, the sliding device and the illumination assembly; and configured to receive the parking area information, instruct the sliding device to slide to the parking area according to the parking area information, and instruct the illumination assembly to shed light, and a detection assembly, disposed on the sliding device, wherein the detection assembly is configured to photograph a vehicle being parked and transmit a photographed image to the controller, the controller is further configured to determine whether the vehicle exceeds the parking space boundary lines according to the image, and send out a warning signal when the vehicle exceeds the parking space boundary lines; or wherein the detection assembly is configured to photograph a vehicle being parked and transmit a photographed image to the control device; the control device is further configured to determine whether the vehicle exceeds the parking space boundary lines according to the image, and instruct the controller to send out a warning signal when the vehicle exceeds the parking space boundary lines.

2. The parking management system according to claim 1, wherein the parking management system further comprises a vehicle image acquisition device and a parking area image acquisition device, wherein the vehicle image acquisition device is configured to acquire a vehicle image of the vehicle to be parked and send the vehicle image to the control device;

the parking area image acquisition device is configured to acquire a parking area image of a parking area in the parking lot, and send the parking area image to the control device; and the control device is connected with the vehicle image acquisition device and the parking area image acquisition device; and is configured to acquire the size information of the vehicle to be parked from the vehicle image and acquire the information of the vacant area from the parking area image through image processing, determine the parking area information of the vehicle to be parked according to the size information of the vehicle to be parked and the information of the vacant area, and send the parking area information to the parking space boundary indicating device.

3. The parking management system according to claim 2, wherein the information of the vacant area includes a position and a size of the vacant area, and the parking area information includes a position and a size of the parking area.

4. The parking management system according to claim 2, wherein the information of the vacant area comprises a position and a size of the vacant area, and the parking area information comprises instruction information for instructing to shed light to form the parking space boundary lines.

5. The parking management system according to claim 1, wherein an ultrasonic transmitting and receiving device is disposed on the sliding device.

6. The parking management system according to claim 1, wherein the illumination assembly comprises:

a light shade, connected with the sliding device;

a light source, disposed in the light shade; and a light adjustment mechanism, disposed at a light outlet of the light shade, and configured to adjust a shape of the parking space boundary lines formed on the ground by changing a shape of the light outlet.

7. The parking management system according to claim 6, wherein the light adjustment mechanism is configured to adjust the shape of the parking space boundary lines formed on the ground according to an instruction of the controller.

8. The parking management system according to claim 6, wherein the light adjustment mechanism comprises a pair of width baffles for adjusting width of the light outlet and a pair of length baffles for adjusting length of the light outlet.

9. The parking management system according to claim 6, wherein the light shade is movably connected with the sliding device.

10. A parking management method, comprising:

acquiring, by a control device, size information of a vehicle to be parked and information of a vacant area where no vehicle is parked in a parking lot;

determining, by the control device, parking area information of the vehicle to be parked according to the size information of the vehicle to be parked and the information of the vacant area; and forming, by a parking space boundary indicating device, parking space boundary lines by shedding light on a parking area, wherein the parking space boundary indicating device comprises: a guide rail, disposed above a parking area; a sliding device, slidably disposed on the guide rail and configured to slide to the parking area under an instruction of a controller; an illumination assembly, disposed on the sliding device and configured to shed light under the instruction of the controller, to form the parking space boundary lines from light in the parking area; the controller, electrically connected with the sliding device and the illumination assembly and configured to receive the parking area information, instruct the sliding device to slide to the parking area according to the parking area information, and instruct the illumination assembly to shed light; and a detection assembly disposed on the sliding device, the method further comprising:

photographing, by the detection assembly, a vehicle being parked and transmitting a photographed image to the controller; and determining, by the controller, whether the vehicle exceeds the parking space boundary lines according to the image, and sending out a warning signal when the vehicle exceeds the parking space boundary lines;

or photographing, by the detection assembly, a vehicle being parked and transmitting a photographed image to the control device; and determining, by the control device, whether the vehicle exceeds the parking space boundary lines according to the image, and instructing the controller to send out a warning signal when the vehicle exceeds the parking space boundary lines.

11. The parking management method according to claim 10, wherein acquiring the size information of the vehicle to be parked and the information of the vacant area where no vehicle is parked in the parking lot comprises:

acquiring a vehicle image of the vehicle to be parked and the a parking area image of a parking area in the parking lot respectively;

through image processing, acquiring the size information of the vehicle to be parked from the vehicle image, and acquiring the information of the vacant area from the parking area image.

12. The parking management method according to claim 10, wherein determining the parking area information of the vehicle to be parked according to the size information of the vehicle to be parked and the information of the vacant area comprises:

determining a parking area suitable for parking the vehicle according to the size information of the vehicle to be parked, the information of the vacant area and a preset parking strategy; the preset parking strategy comprises: in a parking area, preferentially parking at a position near an entrance and preferentially parking at an edge position of the vacant area.

13. The parking management method according to claim 10, wherein the information of the vacant area comprises a position and a size of the vacant area, and the parking area information comprises a position and a size of the parking area.

14. The parking management method according to claim 10, wherein the information of the vacant area comprises a position and a size of the vacant area, and the parking area information comprises instruction information for instructing to shed light to form parking space boundary lines.

15. A non-transitory computer readable storage medium, storing computer executable instructions for performing the method according to claim 10.

* * * * *